US005557940A

United States Patent [19]

Hendricks

[11] Patent Number: 5,557,940

[45] Date of Patent: Sep. 24, 1996

[54] PORTABLE HEATING UNIT FOR ON-SITE CHARGING OF A COOLING UNIT

[76] Inventor: Roger G. Hendricks, R.D.#1, Box 73,, Mingo Junction, Ohio 43938

[21] Appl. No.: 549,172

[22] Filed: Oct. 27, 1995

[51] Int. Cl.[6] ..... F25B 45/00

[52] U.S. Cl. ..... 62/149; 62/292

[58] Field of Search ..... 62/77, 85, 149, 62/292, 475

[56] References Cited

U.S. PATENT DOCUMENTS

| | | | |
|---|---|---|---|
| 3,903,709 | 9/1975 | Anderson et al. . | |
| 4,539,817 | 9/1985 | Staggs et al. . | |
| 4,738,115 | 4/1988 | Goode . | |
| 4,766,733 | 8/1988 | Scuderi . | |
| 4,862,699 | 9/1989 | Lounis | 62/149 |
| 4,982,576 | 1/1991 | Proctor et al. . | |
| 5,097,667 | 3/1992 | Gramkow | 62/149 |
| 5,203,177 | 4/1993 | Manz et al. . | |
| 5,246,045 | 9/1993 | Clothier et al. . | |
| 5,249,434 | 10/1993 | Abraham . | |
| 5,377,495 | 1/1995 | Daigle . | |
| 5,406,806 | 4/1995 | Ricketts et al. . | |

*Primary Examiner*—John M. Sollecito
*Attorney, Agent, or Firm*—Wood, Herron & Evans P.L.L.

[57] ABSTRACT

A portable refrigerant charging unit is described which is intended to facilitate the on site charging of refrigerant systems. The uncomplicated design of the portable refrigerant charging unit provides for system that is inexpensive and easy to transport. The portable charging unit includes high temperature and high pressure cut outs to interrupt power to the heater and blower when a predetermined temperature or pressure is reached.

6 Claims, 1 Drawing Sheet

PORTABLE HEATING UNIT FOR ON-SITE CHARGING OF A COOLING UNIT

FIELD OF THE INVENTION

The present invention is directed to a refrigerant charging apparatus and, more particularly, to a portable heating unit for adding refrigerant to an undercharged cooling system.

BACKGROUND OF THE INVENTION

On-site charging of cooling systems such as air conditioners, freezers, and refrigerators is problematic in cold weather because the refrigerant cools to the point where it is difficult to sustain a vapor charging pressure. Furthermore, vaporization of the refrigerant causes atmospheric humidity to freeze on the outside of the refrigerant container.

There are many known techniques for facilitating the transfer of refrigerant from a charging cylinder to the unit requiring charging. For example, U.S. Pat. No. 5,377,495, issued to Daigle, discloses a refrigerant transfer system utilizing a temperature controlled thermal jacket for selectively heating and cooling a refrigerant cylinder, the thermal jacket being controlled by an electronic motor, a thermostat, a temperature probe, and a high temperature cut out. U.S. Pat. No. 5,249,434, issued to Abraham, discloses a device for automatically charging refrigeration systems having a vessel for holding refrigerant containers, a digital controller, a pressure sensor for providing readings to the digital controller, control software, several controls and detection devices for opening and closing valves and detecting errors, and a means for pressurizing the refrigerant by heating the vessel. U.S. Pat. No. 4,539,817 issued to Staggs, U.S. Pat. No. 4,766,733 issued to Scuderi, U.S. Pat. No. 5,406,806 issued to Ricketts, U.S. Pat. No. 3,903,709 issued to Anderson, and U.S. Pat. No. 4,982,576 issued to Proctor all disclose refrigerant charging systems utilizing complex means for storing and heating the refrigerant, as well as complex controls and regulators.

The prior art refrigerant charging systems have the disadvantages of being costly, complicated, and difficult to transport for on-site charging. There is an explicit need for an inexpensive, easily portable unit for charging refrigerant systems.

SUMMARY OF THE INVENTION

The present invention is a simple, inexpensive, and readily portable heating apparatus for charging a cooling unit with refrigerant on site.

In its broadest aspects, the system of the present invention includes a portable enclosure for holding a refrigerant cylinder, a heater and a blower with a power supply for raising the temperature inside the container. The system also includes a high temperature cut out that is electrically connected in series to the heater and blower that interrupts power to the heater and blower when a predetermined temperature is reached. A high pressure cut out, electrically connected in series to the heater and the blower, is also included in the system to provide a backup for the high temperature cut out to prevent the system from overheating the enclosure. Also included in the system is a tee fitting for connecting the refrigerant supply cylinder to the high pressure sensor and the high pressure cutout.

As additional features, the container that holds the refrigerant supply cylinder may have handles attached which enable the apparatus to be easily transported to the cooling system to be charged. Additionally, a lid for sealing the container may be used when one hundred pound refrigerant cylinders are placed in the container.

In addition to the foregoing, further features and advantages of the present invention will become apparent to persons skilled in the art upon review of the following detailed description taken in conjunction with the drawings.

DETAILED DESCRIPTION

Figure 1:
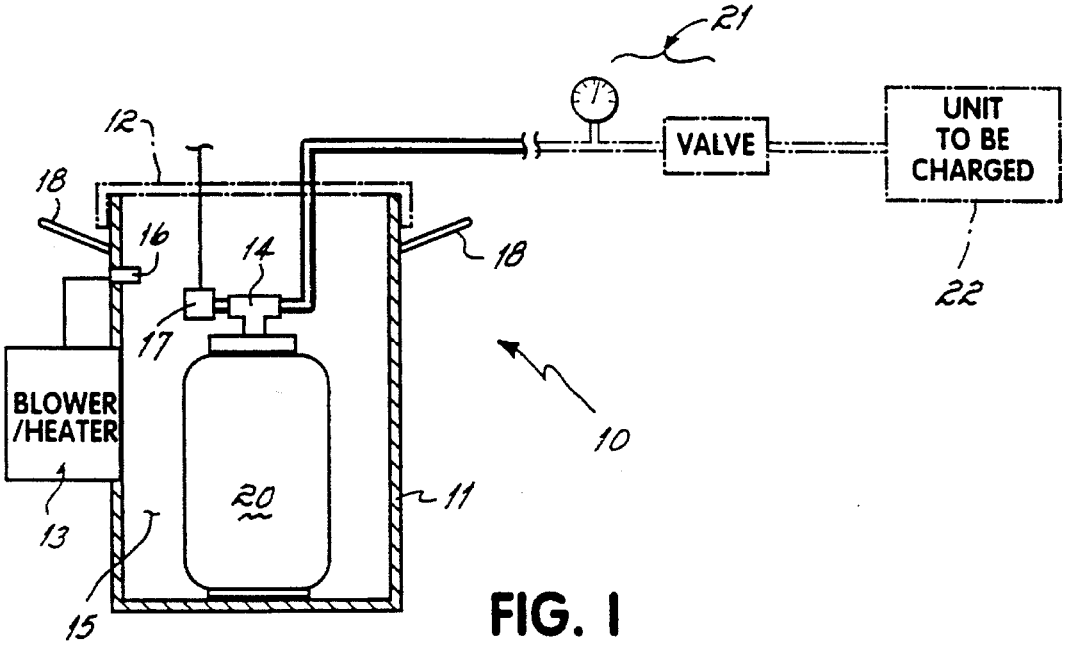
FIG. 1 is a cross-sectional view of the portable refrigerant charging unit of the present invention shown connected to and in fluid communication with a regulator and a refrigerant unit requiring charging in phantom.

With reference to FIG. 1, an embodiment of a protected unit 10 for the on site charging of a cooling system is shown. FIG. 1 depicts the protected unit 10 for the on site charging of a refrigerant system connected in series to and in fluid communication with a regulator valve 21 and the unit requiring charging 22. Regulator valves are well known in the art of charging refrigeration systems and persons of ordinary skill in the art will appreciate the type of regulator required for regulating the charging pressure of the refrigerant to the unit requiring charging.

Portable charging unit 10 comprises an enclosure or housing 11 for holding a refrigerant supply cylinder 20 (which itself forms no part of the present invention). It will be appreciated that the enclosure 11 can be virtually any geometric cross section particularly, cylindrical, square, or hexagonal, to provide a suitable container for enclosing the refrigerant supply cylinder 20. It will be appreciated that enclosure 11 may also have carrying handles 18. The handles 18 may be integral with the enclosure 11, or the handles 18 may be separately fabricated and attached to the enclosure 18 by clips, hooks, rivets, nails, screws, or clamps. An alternative embodiment also includes an accessory lid 12 (shown in phantom) for sealing the enclosure 11.

The portable charging unit 10 also includes a heater and blower 13 that is coupled to the enclosure 11. It will be appreciated that the heater and blower 13 can be any type of electrically powered heater and blower system capable of supplying heated air to space 15 enclosed by the enclosure 11.

The portable charging unit 10 of the present invention also includes a power supply 19 for providing electrical power to the heater and blower 13. It will be appreciated that because the charging unit 10 of the present invention is portable, the power supply 19 can be either an AC or DC power supply.

A high temperature sensor 16 is also provided and is electrically connected in series with the power supply 19 and the blower and heater 13. The high temperature sensor 16 serves as a high temperature cut out, meaning that when a predetermined temperature is reached, the high temperature sensor 16 will break the electrical connection and interrupt power to the heater and blower 13.

A tee fitting 14 connects the refrigerant supply cylinder 20 to a charging line which is connected to and in fluid communication with the regulator valve 21. The third connection on the tee fitting 14 is connected to and in fluid communication with a high pressure sensor 17. The high pressure sensor 17 is electrically connected in series with the heater and blower 13. When a predetermined pressure is reached, the high pressure sensor 17 will break the electrical connection and interrupt power to the heater and the blower 13.

Figure 2:
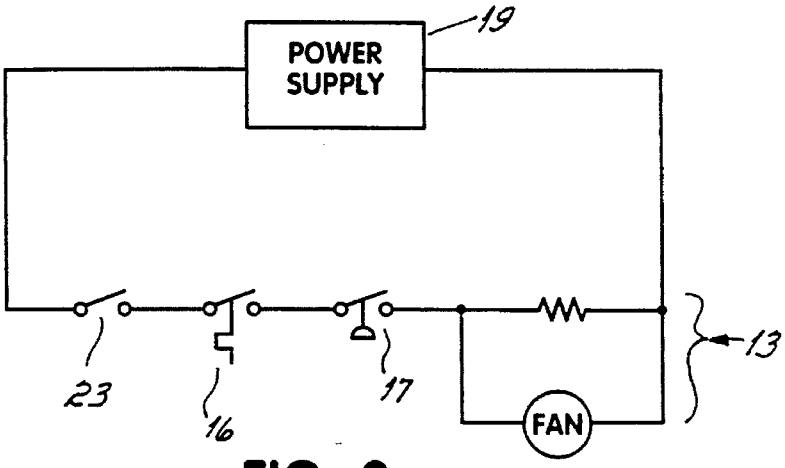
FIG. 2 is a diagram illustrating the electrical circuitry of the portable refrigerant charging unit of the present invention.

In operation, the portable charging unit 10 is carried on site to a refrigeration system requiring charging 22. The refrigerant supply cylinder 20 is placed inside the enclosure 11, and the tee fitting 14 having a high pressure sensor 17 coupled to one input is connected to the refrigerant supply cylinder 20. The third input of the tee fitting 14 is connected to and in fluid communication with the pressure regulating valve 21 and the unit requiring charging 22. Next, the high pressure sensor 17 and the high temperature sensor 16 are set to predetermined values. Power is supplied to the heater and blower 13 by an on/off switch 23 shown in FIG. 2. The heat from the heater and blower raises the temperature of the enclosure 11 that holds the refrigerant supply cylinder 20, causing the pressure in the refrigerant supply cylinder 20 to rise and charge the unit requiring charging 22. The pressure to the unit requiring charging 22 is regulated by the regulator valve 21.

The refrigerant charging unit 10 of the present invention provides a simple and inexpensive method of charging refrigerant systems on site. The lack of complex controls and relatively low number of components enhances the simplicity and portability of the refrigerant charging unit 10 and represents a significant improvement over prior art refrigerant charging systems.

Having thus described the present invention, it will be appreciated by persons skilled in the art that various modifications can be made to the structures shown and described herein without departing from the spirit and scope of the present invention, as defined by the appended claims.

What is claimed is:

1. A portable refrigerant system charging apparatus comprising:

an enclosure for holding a refrigerant supply cylinder, a heater and a blower for raising the temperature within said enclosure, a power supply for said heater and blower, a high temperature sensor for interrupting the power to said heater and blower when a predetermined temperature is reached, a high pressure sensor for interrupting the power to said heater and blower when a predetermined pressure is reached, and a tee fitting for connecting said refrigerant supply cylinder to a charging outlet and to said high pressure sensor.

2. The refrigerant system charging apparatus of claim 1, said enclosure having handles for carrying said enclosure for holding said refrigerant supply cylinder.

3. The refrigerant system charging apparatus of claim 1, said heater and blower mounted to said enclosure for holding said refrigerant supply cylinder.

4. The refrigerant system charging apparatus of claim 1, said enclosure for holding said refrigerant supply cylinder having a lid for sealing said enclosure.

5. The refrigerant system charging apparatus of claim 1, said high pressure sensor being electrically connected in series to said heater and to said blower.

6. The refrigerant system charging apparatus of claim 1, said high temperature sensor being electrically connected in series to said heater and to said blower.

* * * * *